US006896497B2

(12) United States Patent
Kuo

(10) Patent No.: US 6,896,497 B2
(45) Date of Patent: May 24, 2005

(54) AXIAL COMPLIANT MEANS FOR A SCROLL MACHINE

(75) Inventor: Wen-Jen Kuo, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/630,788

(22) Filed: Jul. 31, 2003

(65) Prior Publication Data

US 2005/0025652 A1 Feb. 3, 2005

(51) Int. Cl.[7] ..... F01C 1/04; F01C 19/00
(52) U.S. Cl. ..... 418/55.5; 418/55.4
(58) Field of Search ..... 418/55.4, 55.5, 418/57

(56) References Cited

U.S. PATENT DOCUMENTS 5,102,316 A * 4/1992 Caillat et al. ..... 418/55.5
5,277,563 A * 1/1994 Wen-Jen et al. ..... 418/55.5
6,146,119 A * 11/2000 Bush et al. ..... 418/55.5
6,582,210 B2 * 6/2003 Sano et al. ..... 418/55.5

FOREIGN PATENT DOCUMENTS

JP 4-362201 * 12/1992 ..... 418/55.5

* cited by examiner

*Primary Examiner*—John J. Vrablik
(74) *Attorney, Agent, or Firm*—Troxell Law Office, PLLC

(57) ABSTRACT

An axial compliant means for a scroll machine, wherein a second scroll revolves around a first scroll to form multiple compression chambers including a low pressure chamber, a medium pressure chamber and a high pressure chamber with working fluid pressure in them increasing gradually and radial-inwardly; a piston with multiple guided holes being subject to pressure of the working fluid connecting to one of those compression chambers through a flow passage is pushed-sliding straight by corresponding multiple guiding posts and pushing both of the scrolls to be axially in touch and sealed with each other.

5 Claims, 11 Drawing Sheets

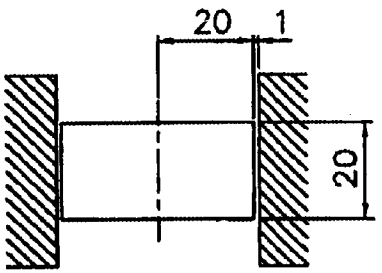
FIG.5D
PRIOR ART
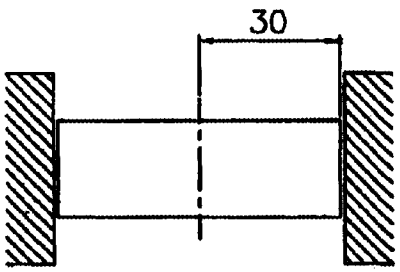
FIG.5E
PRIOR ART
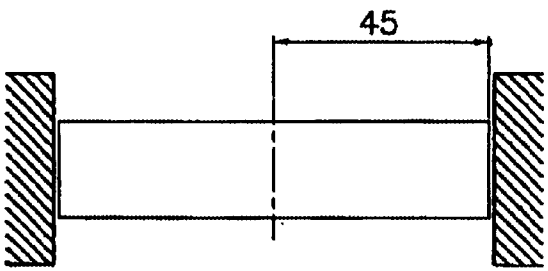
FIG.5F
PRIOR ART
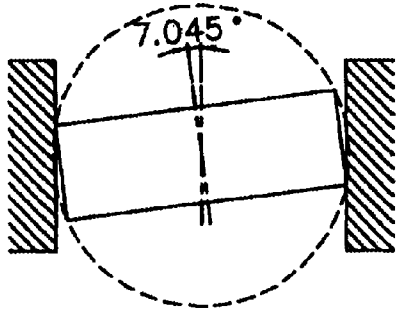
R=20
FIG.5A
PRIOR ART
R=30
FIG.5B
PRIOR ART
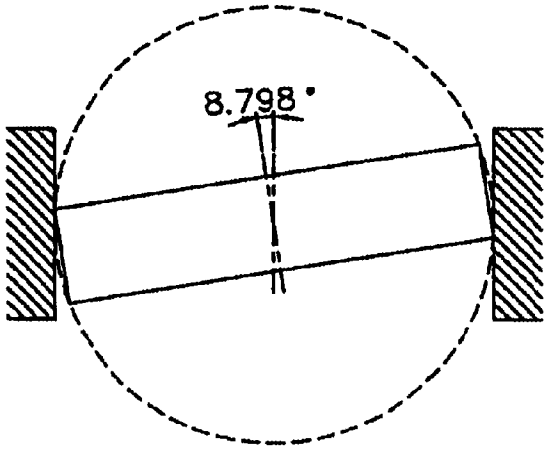
R=45
FIG.5C
PRIOR ART

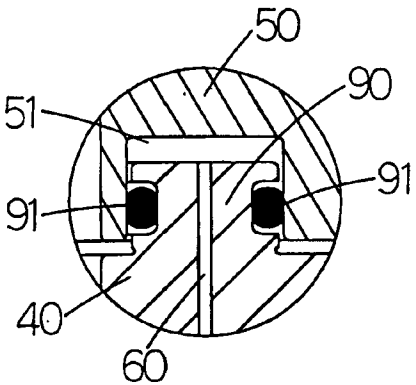
FIG.11B
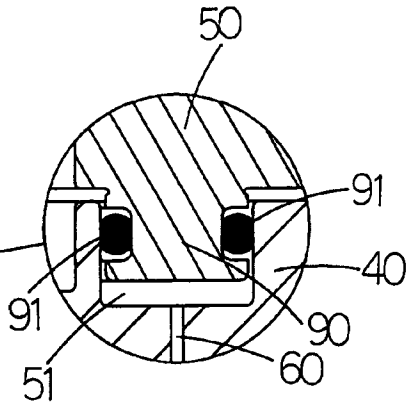
FIG.11A
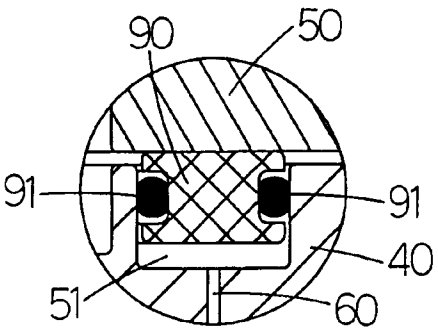
FIG.11C
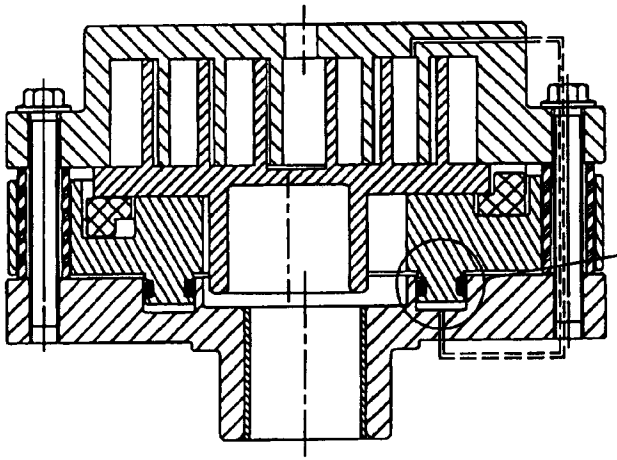

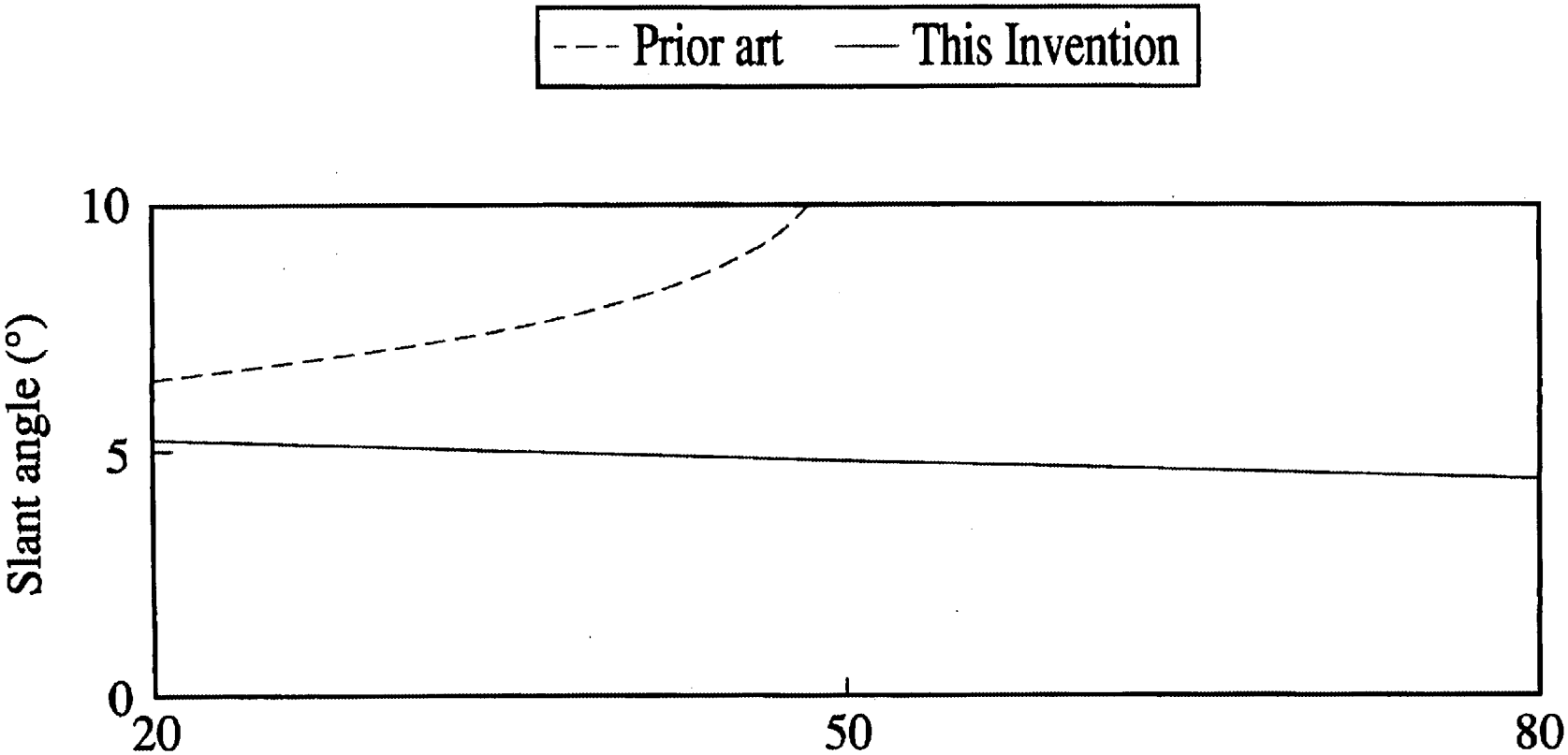
Table.1

AXIAL COMPLIANT MEANS FOR A SCROLL MACHINE

BACKGROUND OF THE INVENTION (a) Field of the Invention

The present invention is related to an axial compliant means for a scroll machine, and more particularly to one that achieves for both of the first and the second scrolls a better axial sealing effect by having multiple guiding posts provided at where a piston with corresponding multiple guided holes is pushed-sliding straight and pushing both of the scrolls to be axially in touch and sealed with each other.

(b) Description of the Prior Art

As illustrated in FIG. 1 of the accompanying drawings for a sectional view of a conventional scroll machine containing an axial compliant means of the prior art (U.S. Pat. No. 5,277,563), the scroll machine is essentially comprised of a orbiting scroll (A1) revolving around a fixed scroll (A2) to form multiple compression chambers (A3) including a low pressure chamber (A31), a medium pressure chamber (A32) and a high pressure chamber (A33) with working fluid pressure in them increasing gradually and radial-inwardly.

Both of the orbiting scroll (A1) and the fixed scroll (A2) are axially (and radially) engaged to each other to form the compression chambers. Therefore, an axial sealing effect is required between the orbiting scroll (A1) and the fixed scroll (A2) to avoid leakage of working fluid in compression chambers in the process of compression. As illustrated, an annular recess (A51) containing an annular piston (A5) is formed on a frame (A4). A flow passage (A6) connecting one side to the medium pressure chamber (A32) of those compression chambers (A3) defined by both of the scrolls (A1, A2) through the first scroll and connecting the other side to an annular recess (A51) through the body of the frame is provided so as to guide the working fluid in the medium pressure chamber (A32) to the annular recess (A51). The pressure of the working fluid in the medium pressure chamber (A32) is greater than the suction pressure of the machine and not greater than the discharge pressure of the machine so as to create an appropriate force to push the annular piston (A5) to be against the orbiting scroll (A1) and pushing the orbiting scroll (A1) and the fixed scroll (A2) to be axially in touch and sealed with each other.

Whereas the axial sealing of the orbiting scroll (A1) and the fixed scroll (A2) is produced by the annular piston (A5) pushed-sliding and pushing orbiting scroll (A1) to be in touch with the fixed scroll (A2) axially, the sliding slant of the annular piston (A5) directly affects the sealing result formed by both of the orbiting scroll (A1) and the fixed scroll (A2). However, the annular piston (A5) of the prior art tends to slide slantly due to the greater clearance between where it is engaged to the frame (A4) when subject to pressure force exercised by the working fluid, and that compromises the axial sealing result of the orbiting scroll (A1) and the fixed scroll (A2). Reducing the clearance between the annular piston (A5) and the frame (A4) may help straighten the sliding slant of the annular piston (A5), but it requires additional cost to process both of the frame (A4) and the annular piston (A5).

SUMMARY OF THE INVENTION

The primary purpose of the present invention is to provide an axial compliant means to achieve better sealing result for both of the scrolls. To achieve the purpose, a scroll machine is comprised of a first scroll and a second scroll with the latter revolving around the former to form multiple compression chambers including a high pressure chamber, a medium pressure chamber and a low pressure chamber with each compression chamber gradually increasing pressure from the outer compression chamber to the inner compression chamber. A piston being subject to the pressure force exercised by a working fluid flowing through one of those compression chambers is provided to be pushed-sliding and pushing both of the second scroll and the first scroll to be axially in touch and sealed with each other. Multiple guiding posts are provided and secured on the sliding travel of the piston with corresponding multiple guided holes on the piston to decrease possible slant of the sliding piston when guided by those guiding posts.

BRIEF DESCRIPTION OF THE DRAWINGS

FIGS. 5(A), 5(B), and 5(C) 5(C), 5(D), 5(E) and 5(F) are schematic views showing various slant angles created by the piston of the prior art.

FIG. 11(A) is a sectional view showing an enlargement of an annular ring and recess combination of the present invention.

FIG. 11(B) is a sectional view showing an enlargement of an annular ring and recess combination of another preferred embodiment of the present invention.

FIG. 11(C) is a sectional view showing an enlargement of an annular ring and recess combination of another preferred embodiment yet of the present invention.

Table 1 is a chart showing the function of slant angle vs. R.

DETAILED DESCRIPTION OF THE PREFERRED EMBODIMENTS

Figure 1:
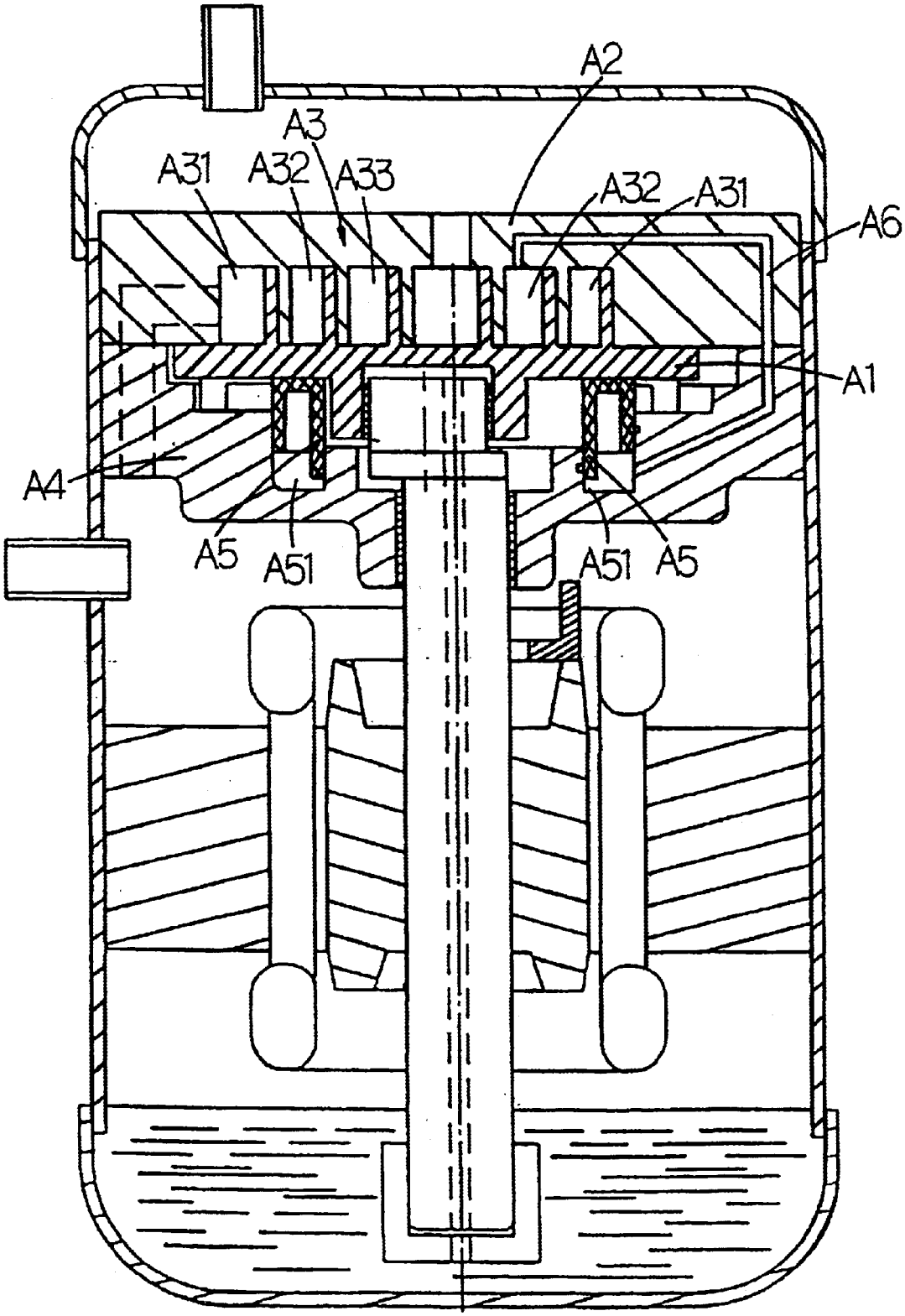
FIG.1 PRIOR ART
FIG. 1 is a sectional view showing a structure of a scroll machine of the prior art.
Figure 2:
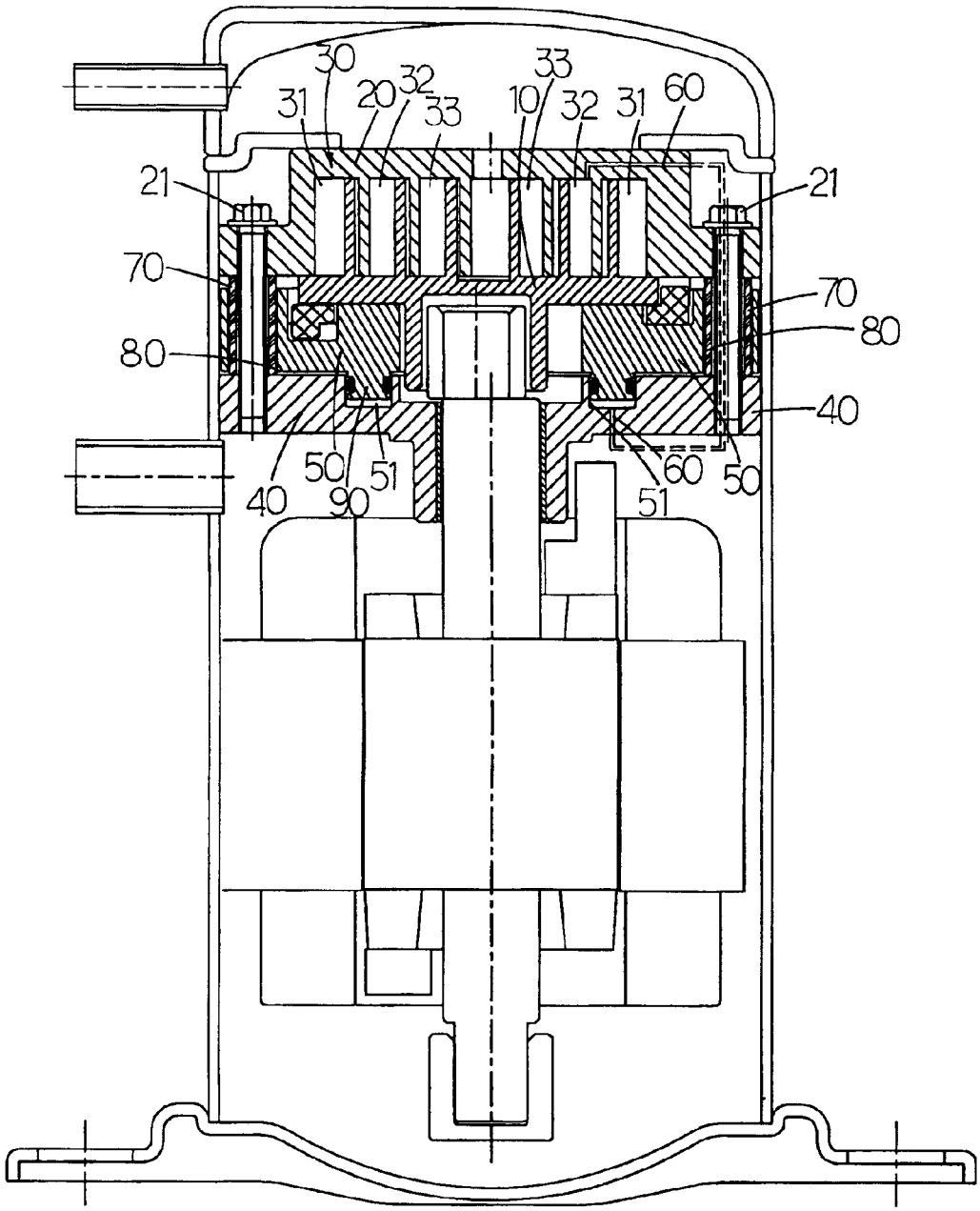
FIG. 2 is a sectional view showing a structure of a scroll machine of the present invention.

Referring to FIG. 2 for a view showing a basic structure of a scroll machine of a preferred embodiment of the present invention, similar to the prior art, a second scroll (10) revolves around a first scroll (20) inside the machine to form multiple compression chambers (30) including a low pressure chamber (31), a medium pressure chamber (32) and a high pressure chamber (33) with working fluid pressure in them increasing gradually and radial-inwardly. Multiple securing bolts (21) are provided to secure the first scroll (20) and multiple guiding posts (70) and a frame (40) circumferentially. A piston (50) with multiple guided holes (80) is sliding-guided straight by corresponding multiple guiding posts (70) and pushing the second scroll (10) and the first scroll (20) to be axially in touch with and sealed with each other.

FIGS. 3, 4, 5 and 6 describe the difference in slant angles created by the piston (50) of the preferred embodiment and the piston (A5) of the prior art when both are axially sliding.

Figure 3A:
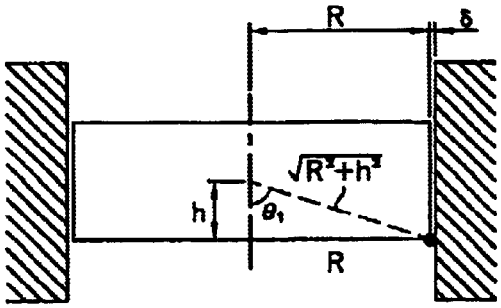
FIG.3A PRIOR ART
FIGS. 3A, 3B are schematic views showing a piston slanting in a guiding recess of the prior art.
Figure 3B:
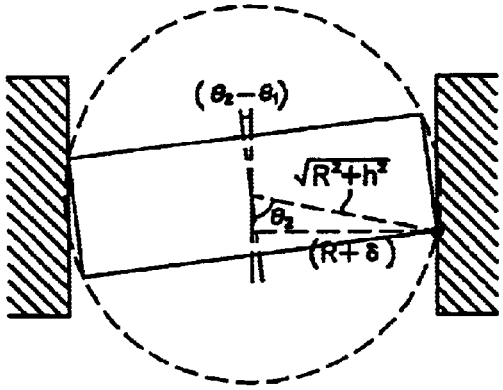
FIG.3B PRIOR ART

As illustrated in FIG. 3, the slant angle, $\theta_2$-$\theta_1$ created during axial sliding of the piston (A5) of the prior art, is derived as follows:

$$\theta_2 - \theta_1 = \sin^{-1}\left((R+\delta)/\sqrt{(R^2+h^2)}\right) - \sin^{-1}\left(R/\overline{(R^2+h^2)}\right)$$
$$= \sin^{-1}\left(\left((R+\delta)h - R/\overline{(h^2-2R\delta-\delta^2)}\right)/(R^2+h^2)\right)$$
$$\left\{\sin^{-1}x - \sin^{-1}y = \sin^{-1}\left(x\overline{(1-y^2)} - y\overline{(1-x^2)}\right),\ xy \quad 0\right\}$$

wherein,

R: slant radius of the piston;

h: ½ height of the piston; and

δ: clearance between the piston and the guiding recess

Figure 4A:
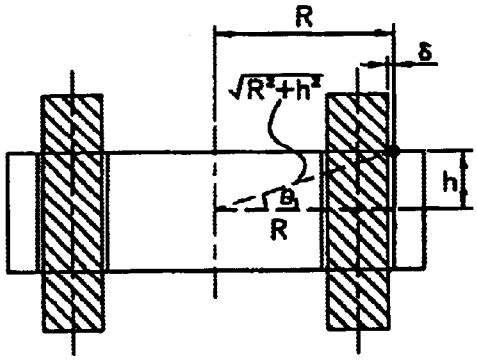
FIGS. 4A, 4B are schematic views showing a piston with multiple guided holes slanting in multiple guiding posts of the present invention.
Figure 4B:
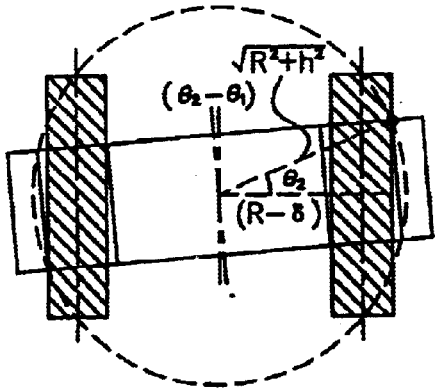
Figure 6D:
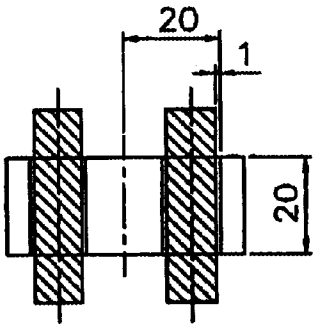
FIGS. 6(A), 6(B), 6(C), 6(D), 6(E) and 6(F) are schematic views showing various slant angles created by the piston of the present invention.
Figure 6A:
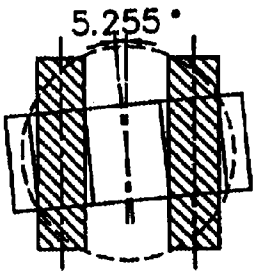
Figure 6E:
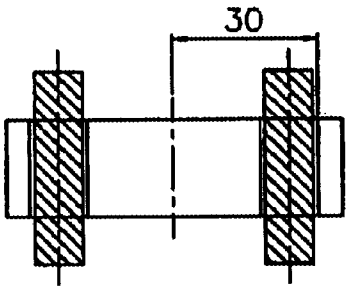
Figure 6B:
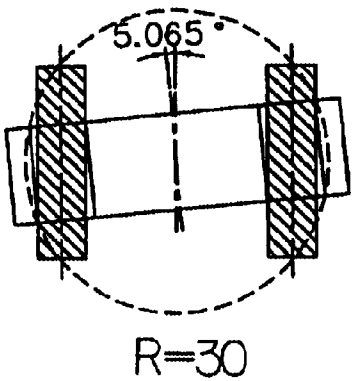
Figure 6F:
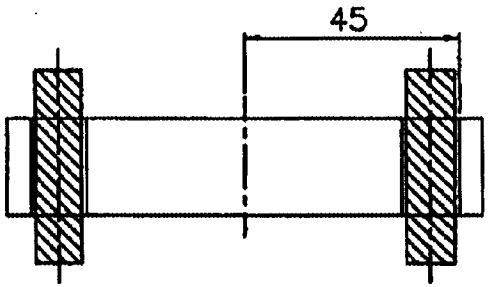
Figure 6C:
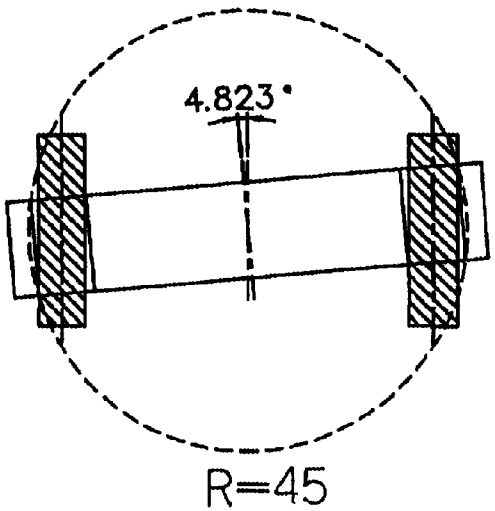

As illustrated in FIG. 4, the slant angle, $\theta_2$-$\theta_1$ created during axial sliding of the piston (50) of the present invention, is derived as follows:

$$\theta_2 - \theta_2 = \cos^{-1}\left((R+\delta)/\sqrt{(R^2+h^2)}\right) - \cos^{-1}\left(R/\overline{(R^2+h^2)}\right)$$
$$= \cos^{-1}\left(\left((R+\delta)R + h\sqrt{(h^2+2R\delta-\delta^2)}\right)/(R^2+h^2)\right)$$
$$\left\{\cos^{-1}x - \cos^{-1}y = \cos^{-1}\left(xy + \overline{(1-x^2)(1-y^2)}\right),\ x < y\right\}$$

wherein,

R: slant radius of the piston;

h: ½ height of the piston;

δ: clearance between a guided hole of the piston and a guiding post.

As illustrated in FIGS. 5 and 6, given with the same h and δ, and R is on the increase, the slant angle created in the present invention decreases while that in the prior art increases accordingly. Furthermore, the relation between the slant angle and R is represented in Table 1, wherein, the slant angle created by the sliding piston (A5) of the prior art drastically increases along with the increase of R and diverges upon increasing to a certain R (i.e., the piston slants around in the annular recess freely without any restriction). On the contrary, the slant angle created by the sliding piston (50) of the present invention consistently decreases as R increases.

Figure 7A:
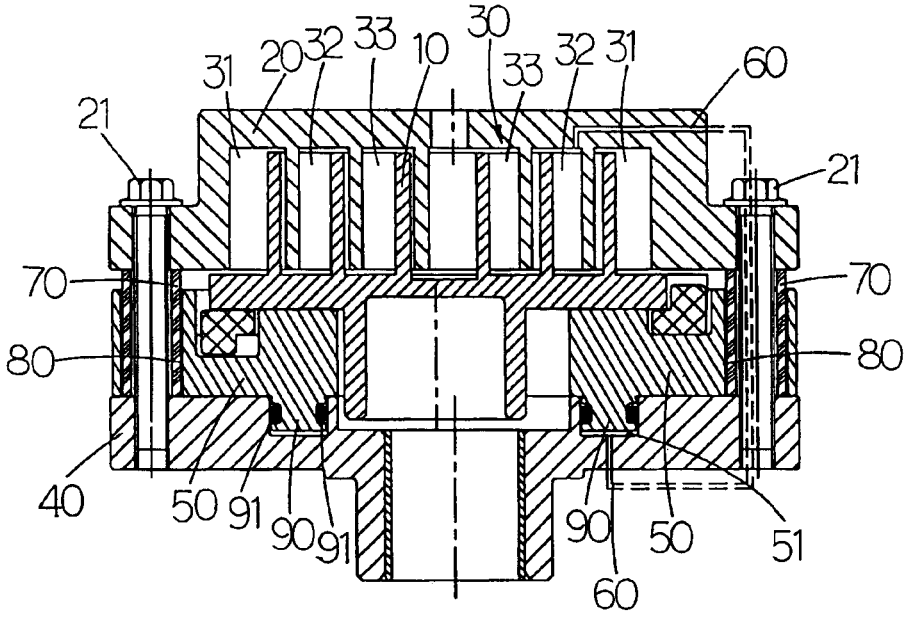
FIG. 7(A) is a sectional view showing a structure of an axial compliant means of the present invention.
Figure 7B:
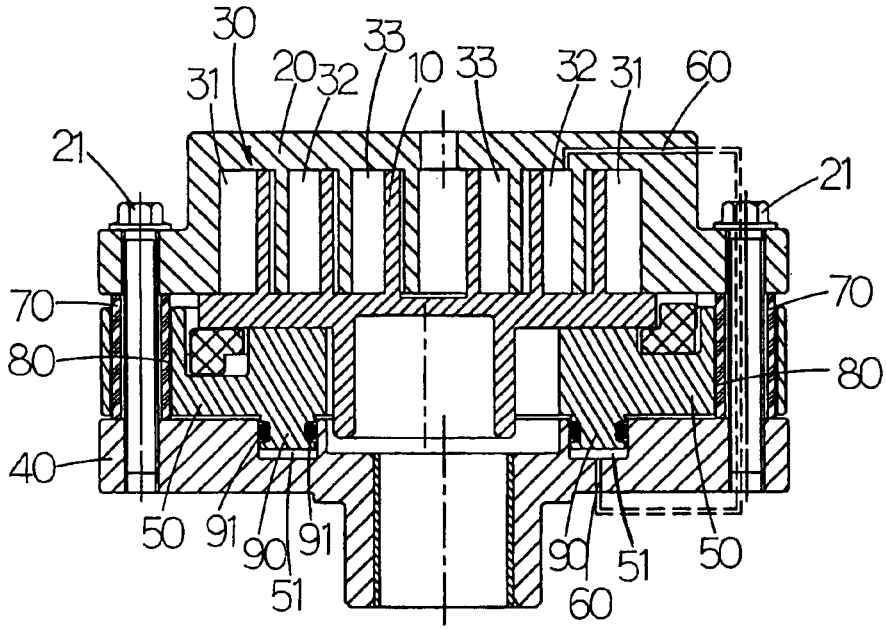
FIG. 7(B) is a sectional view showing that the axial compliant means of the present invention is in operation.
Figure 8:
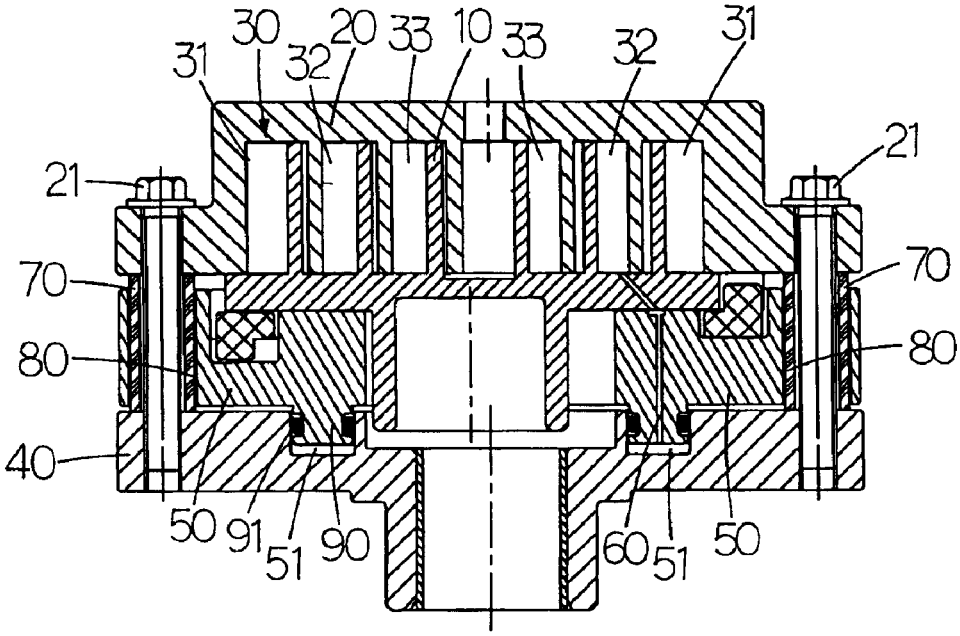
FIG. 8 is a sectional view of an alternative arrangement of a flow passage of the present invention.

Also referring to FIGS. 7(A) and 7(B), respectively showing that the scroll machine of the present invention is in its stationary status and in operation, a flow passage (60) is provided connecting one side to the medium pressure chamber (32) of those compression chambers (30) defined by both of the scrolls through the first scroll (20) and connecting the other side to an annular recess (51) through the body of the frame (40). The pressure of the working fluid in the medium pressure chamber (32) is greater than the suction pressure of the machine and not greater than the discharge pressure of the machine. The working fluid in the medium pressure chamber (32) is guided through the flow passage (60) into the annular recess (51), thus to exercise an appropriate force on the piston (50) to push both of the second scroll (10) and the first scroll (20) to be axially in touch and sealed with each other. Naturally, the flow passage (60) may be arranged as illustrated in FIG. 8, wherein, the flow passage (60) is provided connecting one side to the medium pressure chamber (32) of those compression chambers (30) defined by both of the scrolls through the second scroll (10) and connecting the other side to an annular recess (51) through the body of the piston. The working fluid in the medium pressure chamber (32) is guided through the flow passage (60) into the annular recess (51), thus to exercise a force on the piston (50) to push both of the second scroll (10) and the first scroll (20) to be axially in touch and sealed with each other.

Figure 9A:
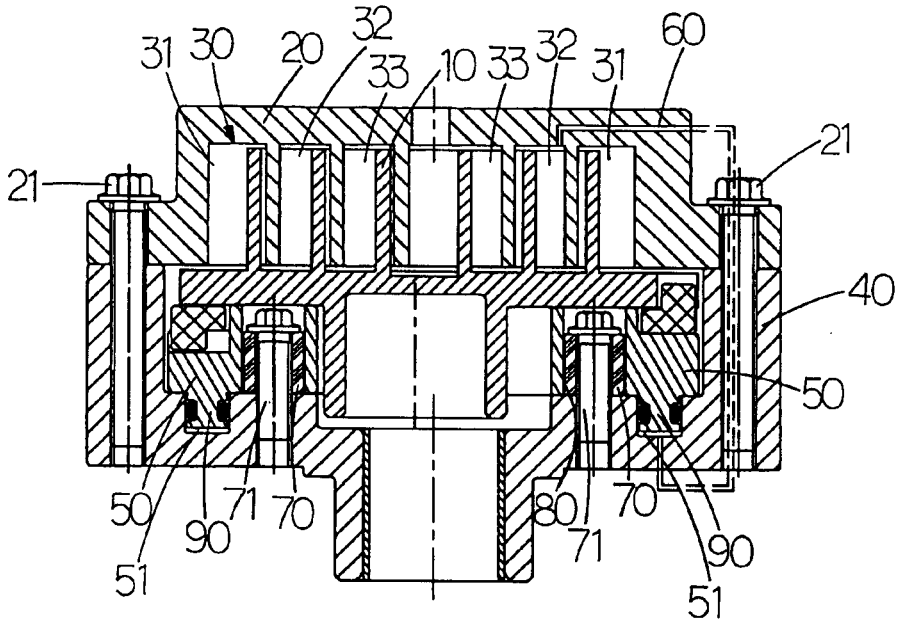
FIG. 9(A) is a sectional view showing a structure of another preferred embodiment of the present invention.
Figure 9B:
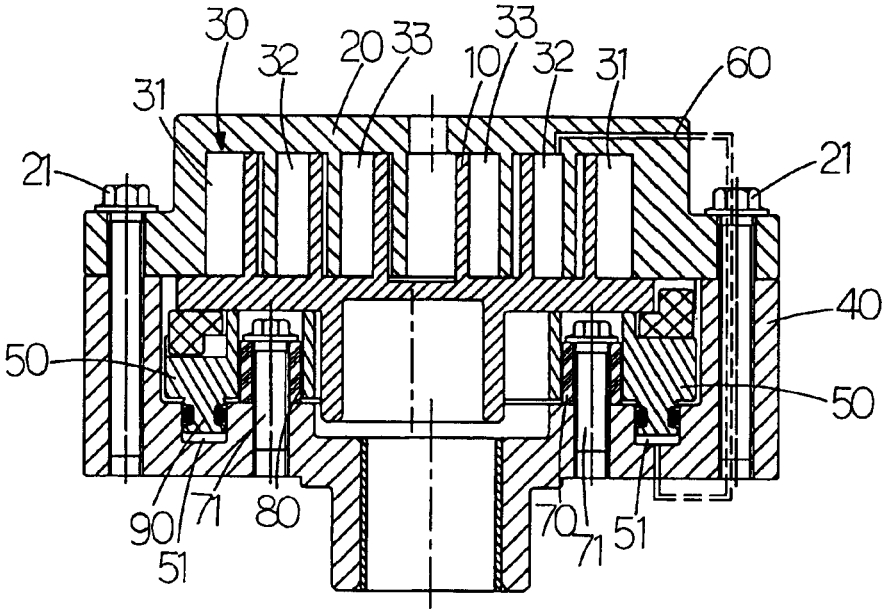
FIG. 9(B) is a sectional view showing that the axial compliant means of another preferred embodiment of the present invention is in operation.
Figure 10A:
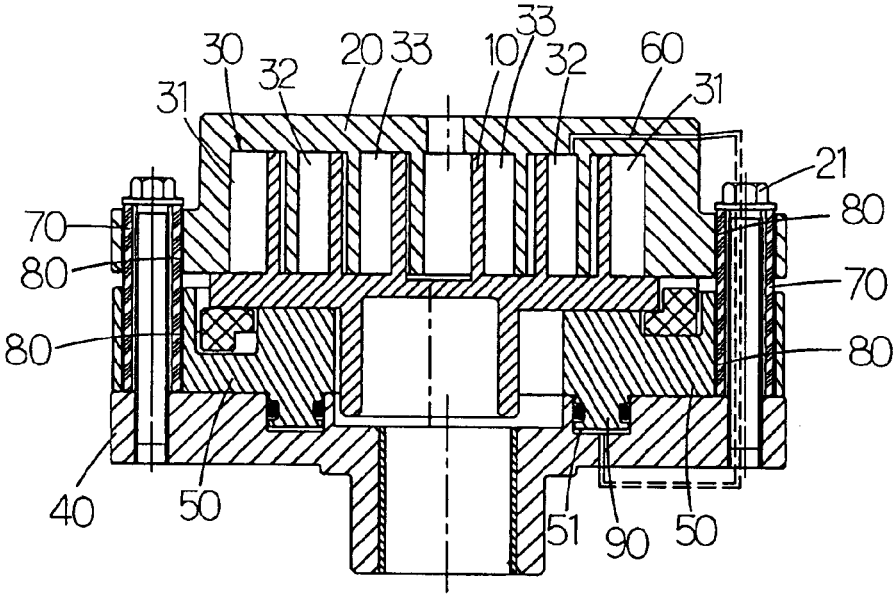
FIG. 10(A) is a sectional view showing a structure of another preferred embodiment yet of the present invention.
Figure 10B:
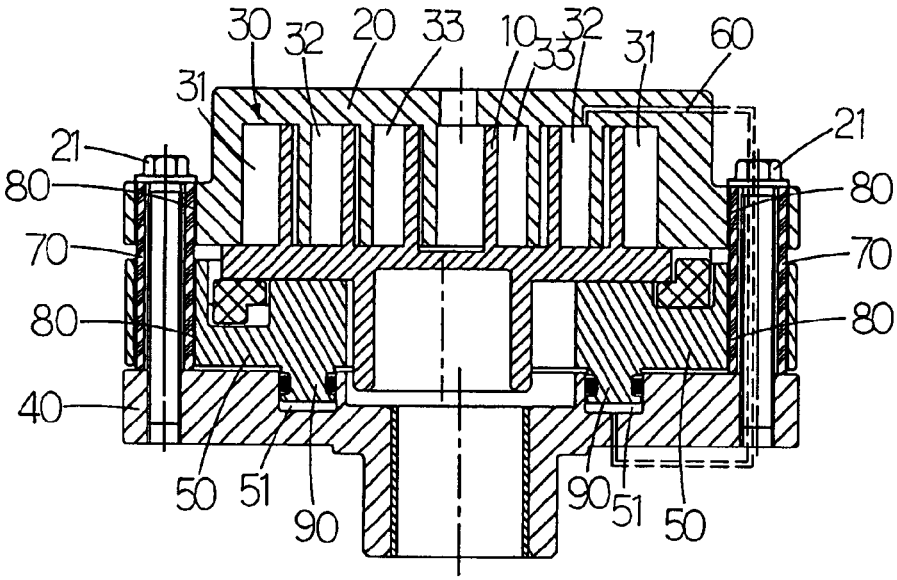
FIG. 10(B) is a sectional view showing that the axial compliant means of another preferred embodiment yet of the present invention is in operation.

For the preferred embodiment illustrated in FIGS. 7(A) and 7 (B), those multiple guiding posts (70) are secured to the first scroll (20) and to the frame (40) by securing bolts (21) while corresponding multiple guided holes (80) are provided on the circumference of the piston (50) to respectively receive the insertion of those multiple guiding posts (70). The slant of the sliding piston (50) is decreased as the piston (50) is guided straight by those multiple guiding posts (70). Naturally, as illustrated in FIGS. 9(A) and 9(B), respectively showing that the scroll machine of the present invention is in its stationary status and in operation, those multiple guiding posts (70) are secured to the frame (40) by securing bolts (71) while corresponding multiple guided holes (80) are provided through the body of the piston (50) to respectively receive the insertion of those multiple guiding posts (70). The slant of the sliding piston (50) is decreased as the piston (50) is guided straight by those multiple guiding posts (70). Or, alternatively, as illustrated in FIGS. 10(A) and 10(B), respectively showing that the scroll machine of the present invention is in its stationary status and in operation, those multiple guiding posts (70) are secured to the frame (40) by securing bolts (21) while corresponding multiple guided holes (80) are provided on the circumference of the piston (50) and of the first scroll (20) to respectively receive the insertion of those multiple guiding posts (70). The slant of the sliding piston (50) is decreased as the piston (50) is guided straight by the multiple guiding posts (70).

Furthermore, as illustrated in FIG. 11(A), the annular recess (51) is formed by an annular ring (90) provided integrally onto the piston (50), inserted into an annular recess (51) on the frame (40) and a sealing element (91) each provided at the inner and outer circumferences of the corresponding annular ring (90) and recess (51). Alternatively, the annular ring (90) is provided integrally onto the frame and inserted into an annular recess (51) on the piston (50) as illustrated in FIG. 11(B), or an independent annular ring (90) is provided and inserted into the annular recess (51) as illustrated in FIG. 11(C) to similarly achieve the purpose.

An axial compliant means for a scroll machine of the present invention by providing a preferred axial compliant means for both of the second scroll and the first scroll of the scroll machine improves the axial sealing result for both of the scrolls in facilitating the production of the scroll machine. This application for a patent is duly filed accordingly. However, it should be noted that any and all the preferred embodiments and accompanying drawings disclosed herein do not in any way limit the present invention;

therefore, any structure, means and/or characteristics that are identical with or similar to those of the prevent invention shall be deemed as falling within the purposes and claims of the present invention.

I claim:

1. An axial compliant means for a scroll machine, wherein, a second scroll revolving around a first scroll, the pressure of a working fluid as a result of such revolution being on the increase gradually and radial-inwardly among multiple compression chambers including a low pressure chamber, a medium pressure chamber and a high pressure chamber; a force being created by the pressure of a working fluid flowing through the medium pressure chamber; a frame supporting the first and second scrolls; a piston pushed by the force pushing both of the second scroll and the first scroll to be axially in touch with each other; and an axial sealing status being achieved for both of the scrolls is characterized by multiple guiding posts being secured on the sliding travel of the piston; the sliding piston being guided by the multiple guiding posts and the slanting angle of the sliding piston being decreased to achieve better axial sealing results for both of the second scroll and the first scroll, wherein the multiple guiding posts being secured to the first scroll and to the frame by securing bolts; and corresponding multiple guided holes being provided on the circumference of the piston to receive insertion of the multiple guiding posts.

2. The axial compliant scroll machine as claimed in claim 1, wherein, a flow passage is provided connecting one side to the medium pressure chamber defined by both of the scrolls through the second scroll and connecting the other side to an annular recess through the body of the piston; the working fluid in the medium pressure chamber being guided through the flow passage into the annular recess; and a force being exercised through the pressure of the working fluid on the piston to push against the second scroll.

3. The axial compliant scroll machine as claimed in claim 2, wherein, the annular recess being formed by an annular ring provided integrally onto the piston and inserted into an annular recess on the frame; a sealing element being each provided sealing respectively the inner and the outer circumferences of the corresponding annular ring and recess.

4. The axial compliant scroll machine as claimed in claim 2, wherein, the annular recess being formed by an annular ring provided integrally onto the frame and inserted into an annular recess on the piston; and a sealing element being each provided sealing respectively the inner and the outer circumferences of the corresponding annular ring and recess.

5. The axial compliant scroll machine as claimed in claim 2, wherein, the annular recess being formed by an annular ring provided independently and inserted into an annular recess on the frame; and a sealing element being each provided sealing respectively the inner and the outer circumferences of the corresponding annular ring and recess.

* * * * *